United States Patent [19]

Kohl

[11] 4,194,943

[45] Mar. 25, 1980

[54] MODIFIED WARP KNITTING MACHINE FOR THE PRODUCTION OF NETTING BY HEAT SEALED WEFT INSERTION

[75] Inventor: Karl Kohl, Obertschausen, Fed. Rep. of Germany

[73] Assignee: Karl Mayer Textilmaschinen Fabrik GmbH, Obertshausen, Fed. Rep. of Germany

[21] Appl. No.: 878,386

[22] Filed: Feb. 16, 1978

[30] Foreign Application Priority Data

Feb. 18, 1978 [DE] Fed. Rep. of Germany ..... 2706930

[51] Int. Cl.[2] ..... D04H 3/04; D04H 3/14

[52] U.S. Cl. ..... 156/441; 156/181

[58] Field of Search ..... 66/203, 208, 85 A, 84 A; 28/101, 102, 100; 156/181, 176, 177, 178, 166, 430, 440, 441, 436, 433, 583, 296, 264, 265, 266, 148, 73.2, 73.1, 306, 290, 519; 428/296, 114, 105, 107, 113, 247, 255

[56] References Cited

U.S. PATENT DOCUMENTS

| | | | |
|---|---|---|---|
| 2,913,888 | 11/1959 | Amidon | 66/84 A |
| 3,123,512 | 3/1964 | Mercer | 156/441 |
| 3,579,823 | 5/1971 | Gressitt | 29/630 |
| 3,916,649 | 11/1975 | Kohl | 28/100 |
| 3,949,111 | 4/1976 | Pelletier | 156/436 |

*Primary Examiner*—Michael W. Ball
*Attorney, Agent, or Firm*—Omri M. Behr

[57] ABSTRACT

There is provided a modified warp knitting machine for the production of netting from heat sealable synthetic fibers which comprises a source or warp threads, inlay sinkers for contacting the weft thread to the warp thread, and heat sealing means for sealing the warp threads and the weft threads together to provide the desired effect.

4 Claims, 2 Drawing Figures

MODIFIED WARP KNITTING MACHINE FOR THE PRODUCTION OF NETTING BY HEAT SEALED WEFT INSERTION

BACKGROUND OF THE INVENTION

Heretofore netting has been manufactured either on knitting machines or on weaving machines both of which require the use of a substantial amount of thread material as well as the necessity for taking measures to stabilize the netting material once it has been formed. Netting material has also been produced from synthetic fibres on specially constructed heat sealing machines. It would be desirable to produce netting on substantially conventional machines in a manner which minimizes the consumption of thread, is independent of the individual threads utilized, and enables production at a high speed.

SUMMARY OF THE INVENTION

In the present invention textile machines, in particular warp knitting machines, having weft insertion means extending the entire length of the machine which are equipped, in addition to the conventional weft insertion means and conventional warp thread guides, with heat sealing means oscillatable backwards and forwards in the swing direction which in conjunction with the inlay sinkers operate to heat seal the weft thread and the warp thread together.

In one of the preferred embodiments of the present invention the inlay sinkers conventionally associated with a full length weft insertion device of a warp knitting machine are provided with buffer bars, removably attached to said sinkers, which interact with the sealing means.

In a further embodiment the needles on the needle bar are replaced with the heat sealing means. In the operation of the device of the present invention the swinging and displacement movements of the warp thread carrying guide bar can be dispensed with. The warp thread running downwardly from the guides can be sealed with the weft thread in a manner to provide a substantial choice of net openings. In addition to the foregoing, the use of additional guide bars may be employed to provide diagonal threads and also pattern thread which can be lapped with and sealed with the net forming thread.

By employment of the present invention it is possible for, say, a conventional warp knitting machine to be adapted very rapidly by the equipment thereof with a heat sealing means, buffer bars and the like, to commence production of net ware in a very simple manner utilizing any desired strength of fibre, if desired at high machine speeds. Furthermore, if and when desired, patterns can also be inserted into the netting.

DESCRIPTION OF THE PREFERRED EMBODIMENT

Figure 2:
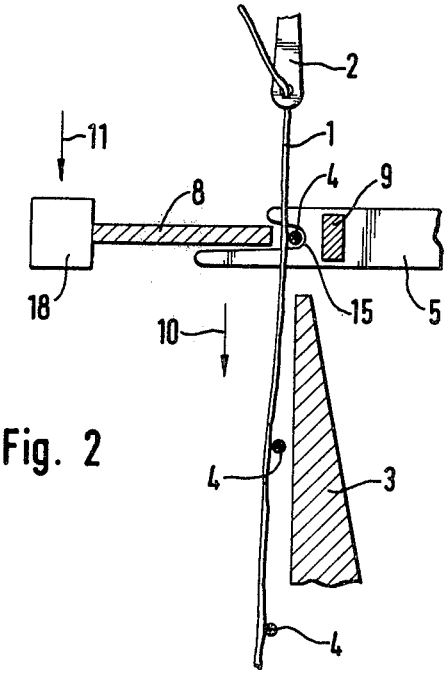
FIG. 2 is another schematic elevational view of the device of FIG. 1 at another stage of the process.
Figure 1:
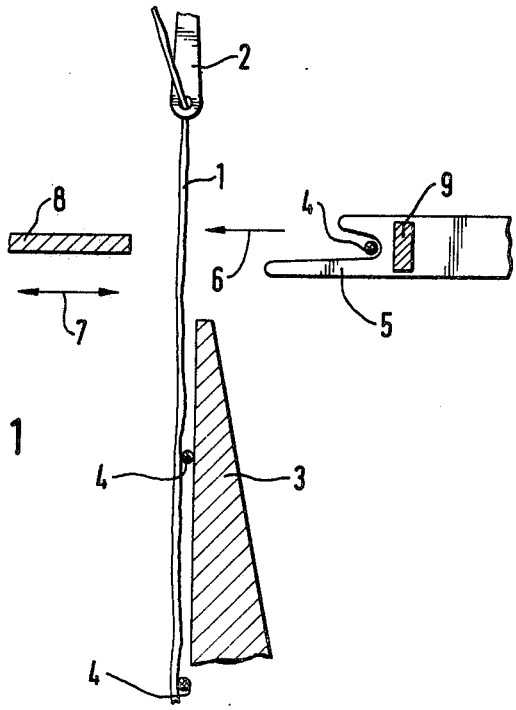
FIG. 1 is a schematic elevational view of a warp knitting machine in the area of the heat sealing device and the weft inserter.

In the drawings there is represented a modified but otherwise conventional warp knitting machine provided with a guide bar (not shown) having a plurality of guides 2 attached thereto through which the warp threads 1 pass in a conventional manner in a downward direction to knock over edge 3. The machine is provided with sealing means 8, said sealing means 8, being mounted, in the embodiment illustrated, on needle bed 18 in place of the needles conventionally located thereon. There are also provided a plurality of inlay sinkers 5 mounted in a conventional manner. Both the needle bed 11 and the sinkers 5 are driven by conventional drive means and are motion controlled and predetermined by conventional control means. In the especially preferred embodiment, a buffer bar 9 is removably mounted on the side of sinker 5 rearwardly of but proximate to the mouth 15 of sinker 5. The buffer bar 9 is preferably a single bar running the length of the machine, however a plurality of such buffers may be employed. The weft threads are laid across the width of the machine in a conventional manner and are carried in the direction of arrow 6 by conventional inlay sinkers 5. The needle bed carrying sealing means 8 is oscillatable in a backwards and forwards swing direction in the immediate environment of warp thread 1. Similarly, inlay sinker 5 carrying weft thread 4 in mouth 15 is oscillatable backwards and forwards into the environment of warp thread 1. The timing of sinker 5 and sealing means 8 is so timed that, as illustrated in FIG. 2, as soon as weft thread 4 has reached warp thread 1 through the movement of inlay sinker 5, the heat sealing means 8 having moved forwardly towards it in the opposite direction presses the warp thread 1 and the weft thread 4 together whereby the warp thread 1 and the weft thread 4 are sealed together.

In the illustrated and preferred embodiment of the present invention this sealing step may be assisted by the presence of buffer bar 9 against which both threads are pressed during the sealing step.

Thereafter the thus formed net ware travels downwardly in direction of arrow 10. This can follow stepwise in time with the sealing.

In another modification, in place of the netting being sealed in one position and being released to move downwardly, the motion of sealing means 8 and sinker 5 can be predetermined in a downward direction so that both move in direction 11 before and during the sealing step, then release the netting and are cycled in the opposite direction to repeat the process.

In addition, two additional guide bars having additional guides attached thereto may be utilized to provide diagonal net threads or pattern threads which can be laid about the sealing point and similarly sealed together with the weft and warp threads.

I claim:

1. In a warp knitting machine for the manufacture of netting from heat sealable fibers having at least one guide bar with a plurality of guides affixed thereon for guiding the warp threads, a weft inserter means, a plurality of inlay sinkers, each of said sinkers having a mouth portion for carrying weft threads, a needle bar, and power drive means, the improvement comprising:

(a) heat sealing means affixed on said needle bar, said needle bar being operatively coupled to said power source for reciprocal movement towards and away from said inlay sinkers;

(b) said inlay sinkers being operatively coupled to said power source for reciprocal movement towards and away from said heat sealing means for cooperating therewith, said sinker mouth portion cooperating with said weft inserter means by receiving said weft threads and carrying said threads towards said heat sealing means; and (c) said guide bars being operatively coupled to said power source for guiding said warp threads, via said guides, into mutual contact with said weft threads, said threads being sealed to each other to form netting upon mutual contact with said heating means and said inlay sinker mouth portion.

2. A warp knitting machine in accordance with claim 1 additionally comprising at least one buffer bar removably attached to the sides of said inlay sinkers proximate to and rearwardly of the mouth portion thereof.

3. A device in accordance with claim 1 additionally comprising at least one other guide bar having thread guides attached thereto to provide diagonal threads.

4. A device according to claim 1 wherein said inlay sinkers and said sealing means are mounted to be oscillatable in a vertical plane as well as in the mutually opposed mode in a substantially horizontal plane.

* * * * *